US011267599B2

(12) United States Patent
Concetti et al.

(10) Patent No.: US 11,267,599 B2
(45) Date of Patent: Mar. 8, 2022

(54) AUTOMATIC BAG FILLING MACHINE WITH SEVERAL FILLING STATIONS

(71) Applicant: CONCETTI S.P.A., Bastia Umbra (IT)

(72) Inventors: Teodoro Concetti, Bastia Umbra (IT); Emanuele Concetti, Bastia Umbra (IT)

(73) Assignee: CONCETTI S.P.A., Bastia Umbra (IT)

( * ) Notice: Subject to any disclaimer, the term of this patent is extended or adjusted under 35 U.S.C. 154(b) by 140 days.

(21) Appl. No.: 16/664,112

(22) Filed: Oct. 25, 2019

(65) Prior Publication Data

US 2020/0130877 A1 Apr. 30, 2020

(30) Foreign Application Priority Data

Oct. 30, 2018 (IT) ..... 102018000009899

(51) Int. Cl.
*B65B 43/46* (2006.01)
*B65B 1/04* (2006.01)
(Continued)

(52) U.S. Cl.
CPC ..... *B65B 43/465* (2013.01); *B65B 1/04* (2013.01); *B65B 43/30* (2013.01); *B65B 51/10* (2013.01);
(Continued)

(58) Field of Classification Search
CPC ..... B65B 39/10; B65B 39/007; B65B 1/26; B65B 1/04; B65B 1/06; B65B 1/02; B65B 1/28; B65B 51/32; B65B 51/26; B65B 51/10; B65B 2051/105; B65B 43/30; B65B 43/43; B65B 43/465; B65B 43/14; B65B 9/13
See application file for complete search history.

(56) References Cited

U.S. PATENT DOCUMENTS 4,510,736 A * 4/1985 Muller ..... B65B 1/02 53/284.7
8,122,684 B2 * 2/2012 Kurz ..... B65B 43/465 53/284.7
(Continued)

FOREIGN PATENT DOCUMENTS

EP 0844175 A1 5/1998
EP 2889590 A1 7/2015
(Continued)

OTHER PUBLICATIONS

Italy Search Report and Written Opinion for Italy Application No. 201800009899 dated Aug. 22, 2019, 8 pages.

*Primary Examiner* — Thomas M Wittenschlaeger

(57) ABSTRACT

A machine for filling bags with loose products extends along a longitudinal direction of advancing movement of the bags. The machine includes a station for feeding a bag to a pick-up position, and a plurality of filling stations for filling a respective bag, arranged in succession along the longitudinal direction, downstream of the pick-up position. The bags are picked up and transported from one station to another station. The pick-up position and filling stations are arranged at a predefined and equal distance from each other, corresponding to a step between adjacent stations in the longitudinal direction. The bags are transported by performing single translation movements in the longitudinal direction.

18 Claims, 9 Drawing Sheets

(51) Int. Cl.

| | |
|---|---|
| ***B65B 43/30*** | (2006.01) |
| ***B65B 51/10*** | (2006.01) |
| ***B65B 51/32*** | (2006.01) |

(52) U.S. Cl.
CPC ..... *B65B 51/32* (2013.01); *B65B 2051/105* (2013.01)

(56) References Cited

U.S. PATENT DOCUMENTS

| | | | | |
|---|---|---|---|---|
| 8,312,984 | B2 * | 11/2012 | Scott | B65B 43/16 198/465.4 |
| 8,572,937 | B2 * | 11/2013 | Gustafsson | B65B 43/465 53/558 |
| 9,873,532 | B2 * | 1/2018 | Canestri | B65B 1/32 |
| 2020/0231317 | A1 * | 7/2020 | Sjolander | B65B 43/30 |

FOREIGN PATENT DOCUMENTS

| | | | |
|---|---|---|---|
| EP | 2925622 | B1 | 12/2018 |
| GB | 2098165 | A | 11/1982 |
| WO | 2009041909 | A1 | 4/2009 |
| WO | 2010002334 | A1 | 1/2010 |
| WO | 2014072949 | A1 | 5/2014 |

* cited by examiner

AUTOMATIC BAG FILLING MACHINE WITH SEVERAL FILLING STATIONS

CROSS-REFERENCE TO RELATED APPLICATIONS

The present application claims the benefit of Italian patent application no. 102018000009899, filed on Oct. 30, 2018, a certified copy of which was submitted in the file of the present application on Oct. 30, 2019.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A SEQUENCE LISTING

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates to an automatic machine for filling bags with a metered quantity of loose material and to a method for filling bags.

Brief Description of Related Art

It is known in the products sector relating to the packaging of loose material that there exists the need to arrange said material inside bags which must be filled with a given quantity of material and then sealed.

It is also known that, for this purpose, automatic bag filling machines have been developed, an example of such machines consisting of so-called forming and filling machines which are able to perform at high speed the cycle for forming the bag, filling the bag and performing final sealing of the bag mouth.

Said machines, known per se, are for example illustrated in FIGS. 1 and 2 which show an FFS machine with a forming station F, a filling station R with fixed grippers for filling the bag which are attached to the product filling mouth, provided with a rotating opening/closing valve 210, and a station S for sealing the mouth of the bag and a conveyor 113 for conveying the filled and sealed bag out of the machine. FIG. 2 also shows the working sequence performed by means for transporting the bag from one station to another with opening of the mouth, closing of the mouth after filling and sealing of the mouth with release by the grippers.

FIG. 3 shows a further example of embodiment of an FFS machine according to the patent EP 2,889,590, which comprises two filling stations, arranged in-line along a longitudinal direction of advancing movement of the bags, where a first and second partial metered amount of product is fed to a same bag so as to allow, in the case of very voluminous and/or fluidified products, the compaction of the bag in two partial processes which are more efficient because they are carried out on smaller amounts of products.

Although performing its function, said bag filling operation, which takes place in two steps, involves a substantial reduction in the productivity of the machine, due to the need to wait for completion of the second partial filling operation before transporting the bag to the following stations.

Also known from EP 2,925,622 are machines which comprise two filling stations which are arranged in-line, along a longitudinal direction of feeding of the bags through the machine, to which pairs of bags arranged alongside each other in the longitudinal direction and with their mouth oriented parallel to said longitudinal direction are fed.

The machine according to EP 2,925,622 works with pairs of pre-formed bags which are fed simultaneously to pairs of transport means, which perform always a same translation movement, both forwards and backwards, between the feeding stations and the filling stations.

This solution is inconvenient because it requires essentially a duplication of the machine configuration with a single filling station, in particular for feeding and movement of the bags, with a consequent significant increase in the dimensions of the machinery, but with only a corresponding partial increase in the production capacity.

Further examples of filling machines according to the prior art are described in GB 2,098,165 A, EP 0,844,175 A1 and WO 2009/041909 A1.

SUMMARY OF THE INVENTION

The technical problem which is posed, therefore, is that of providing a machine for filling bags with loose material, able to fill bags working at high speed so as to achieve a further increase in the hourly production rate and satisfy the demands of the modern-day industry concerned.

In connection with this problem it is also required that the machine should have small dimensions, be easy and inexpensive to produce and assemble and be able to be easily installed at any user location.

It is also desirable that the machine should be able to fill with voluminous and fluidified products bags which are formed from a roll of tubular material associated with the said machine.

These results are achieved according to the present invention by an automatic machine for filling bags with an increased productivity according to the characteristic features of the claimed invention.

With such a machine it is in fact possible to achieve an increased hourly production, in particular owing to the fact that two or more bags may be filled during each machine cycle, reducing substantially the idle time due to the intermittent movement of the transport means which displace the bags and ensuring compact dimensions of the machine.

According to a preferred embodiment, the transport means are operated so as to perform a number of single translation movements in a sense (V2) opposite to the sense of advancing movement of the bags in the longitudinal direction, equal to the number of filling stations, before performing a single translation movement in a sense concordant with the sense of advancing movement of the bags in the longitudinal direction. In a particularly preferred manner the number of filling stations is equal to two.

The teachings of the present invention may be applied in particular to a forming and filling machine, in which the bags fed one at a time to the single pick-up position are formed along the line from a tubular material, preferably by means of a forming station provided with means for sealing the bottom of each bag, arranged in said pick-up position.

In particularly preferred applications, the machine may comprise a number of bag mouth sealing stations equal to the number of filling stations arranged in succession at a relative distance of one step from each other and from the last filling station in the longitudinal direction and, optionally, a corresponding number of stations for cooling the sealed mouth of the bag, arranged in succession at a relative distance of one step from each other and from the last bag mouth sealing station.

As regards the number of pairs of gripping means, this is preferably a multiple ≥2 of the number of filling stations, in particular it may be equal to twice the number of filling stations, plus the number of cooling stations.

The transport means may comprise a polygonal, preferably quadrangular, frame or carriage which carries the pairs of gripping means and is movable translatably in both senses of the longitudinal direction.

The present invention relates furthermore to a method for filling bags with material according to the characteristic features of the claimed invention.

Preferred embodiments of the method are described in the respective dependent claims.

BRIEF DESCRIPTION OF THE SEVERAL VIEWS OF THE DRAWINGS

Further details may be obtained from the following description of non-limiting examples of embodiment of the subject of the present invention, provided with reference to the accompanying drawings, in which.

DETAILED DESCRIPTION OF THE INVENTION

Figure 1:
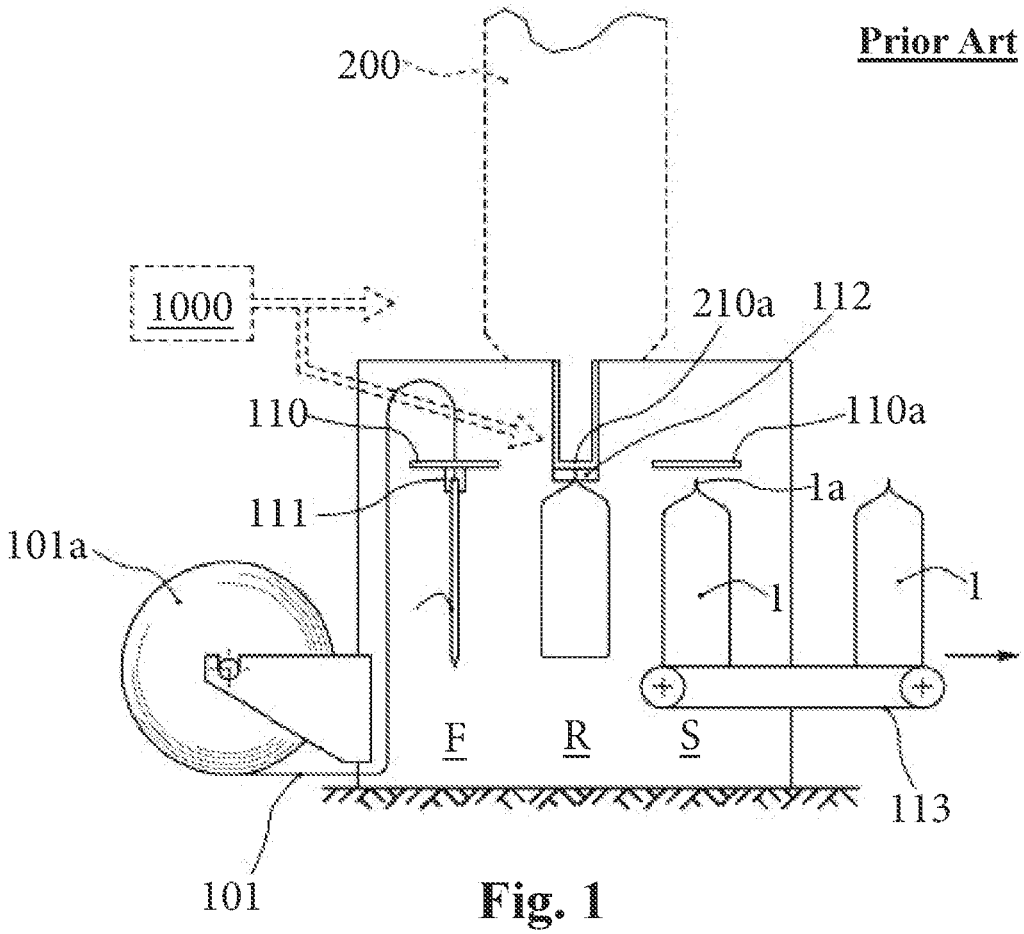
FIG. 1: is a schematic side view of a forming and filling machine with a filling apparatus according to the prior art.
Figure 2:
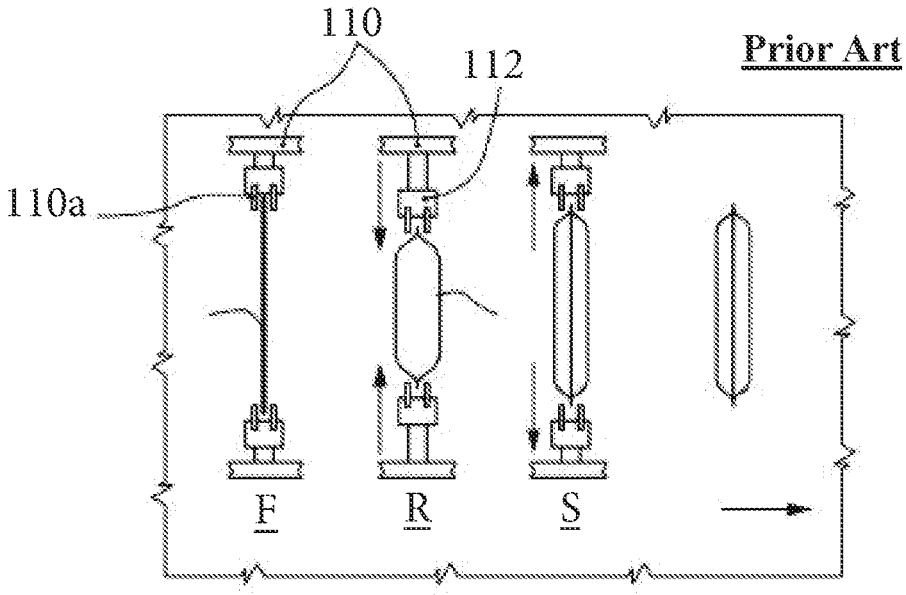
FIG. 2: is a schematic view of the operating sequence of the forming and filling machine according to FIG. 1.
Figure 3:
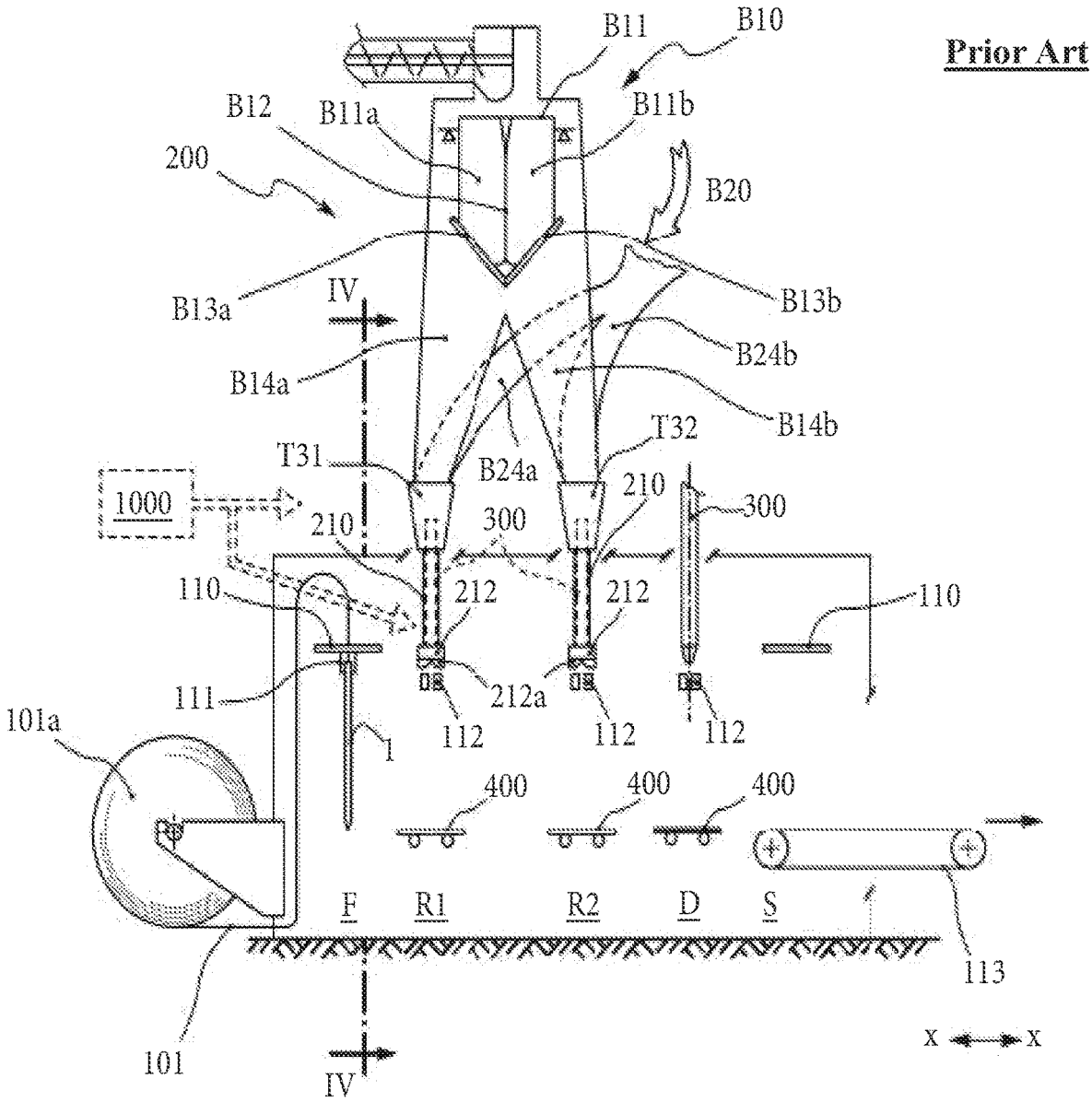
FIG. 3: is a schematic side view of a further forming and filling machine with a metering and filling apparatus according to the prior art.
Figure 4:
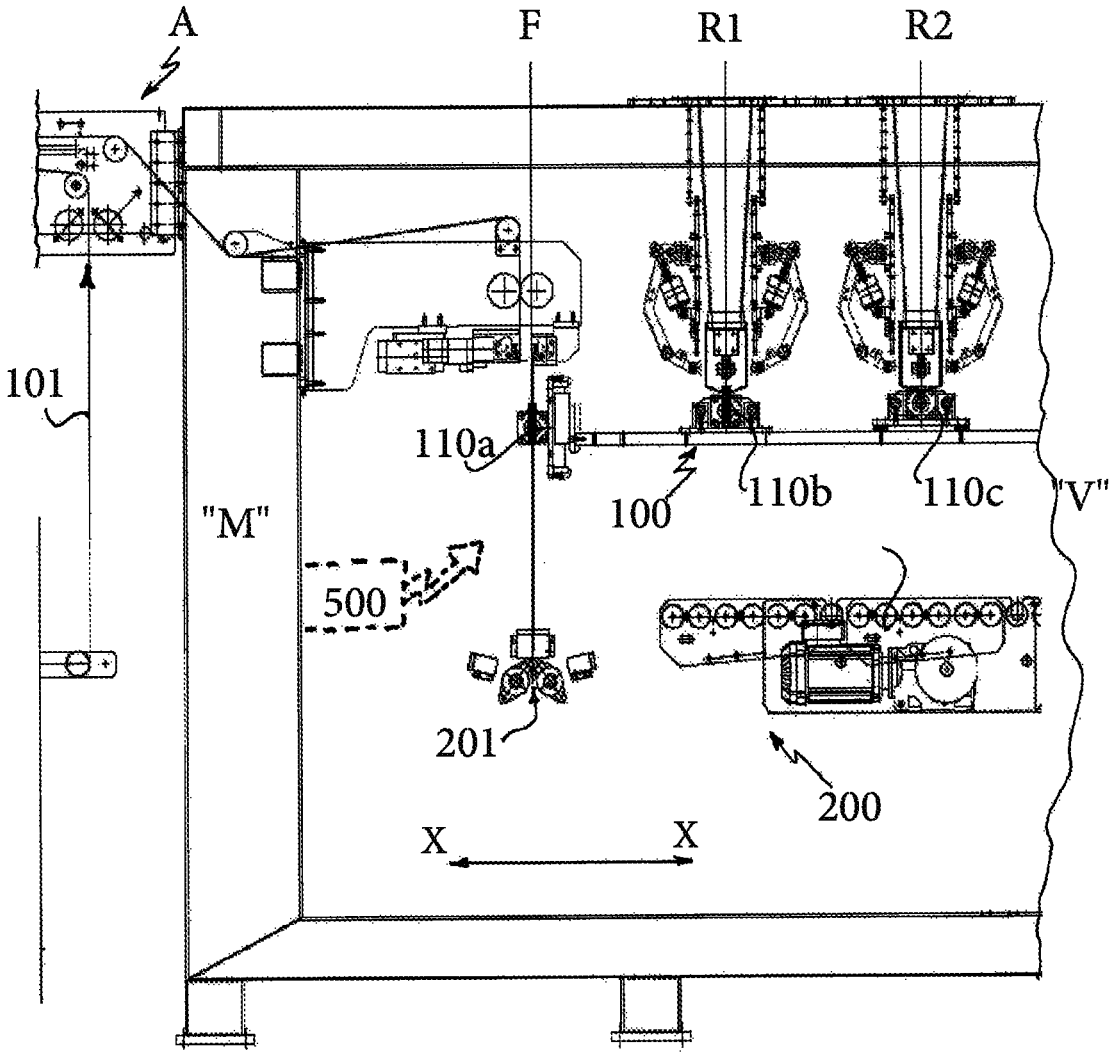
FIG. 4: is a side view of a first example of embodiment of a machine according to the present invention during picking up of a first bag.
Figure 5:
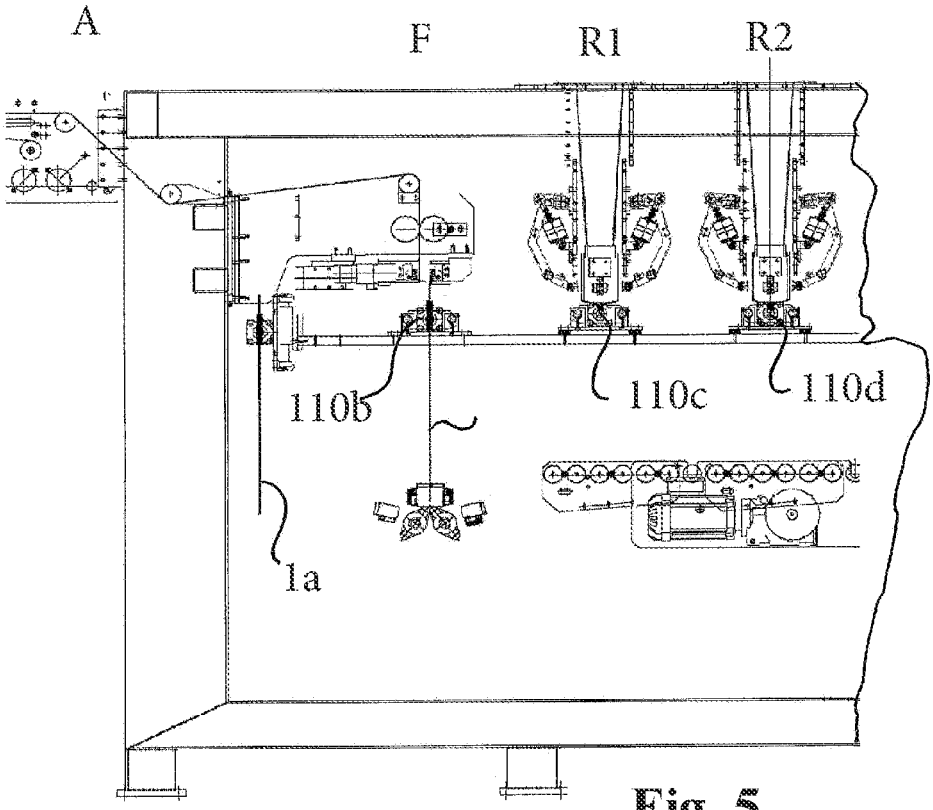
FIG. 5: is a view similar to that of FIG. 4 with a machine during picking up of a second bag.
Figure 6:
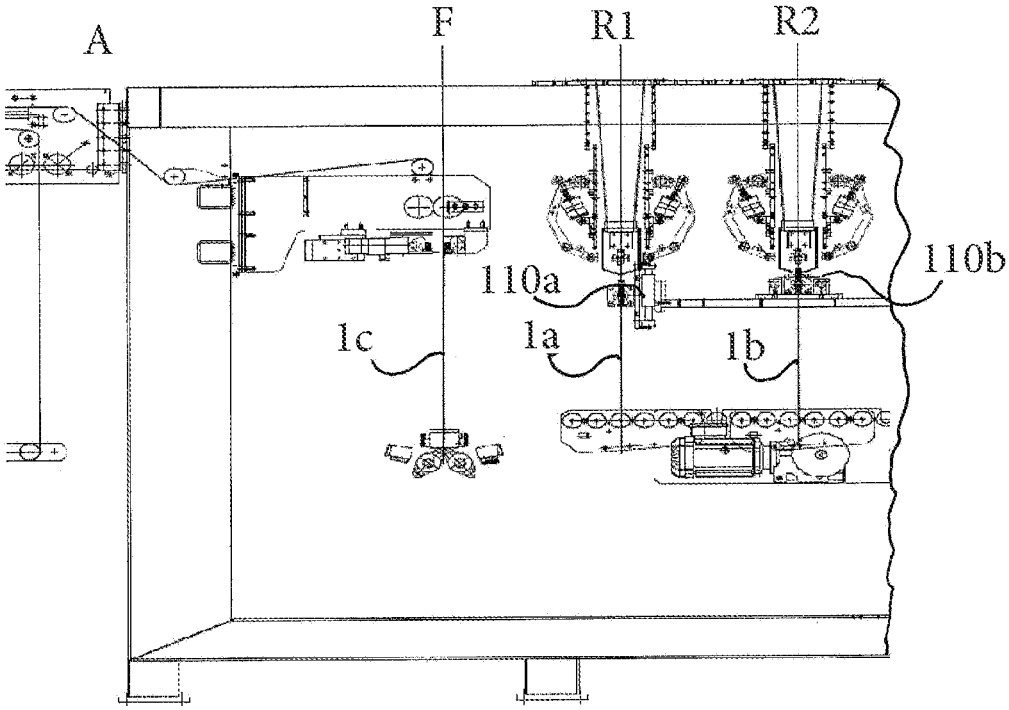
FIG. 6: is a view similar to that of FIG. 4 with a machine during transportation of the two bags to the respective filling station.
Figure 7:
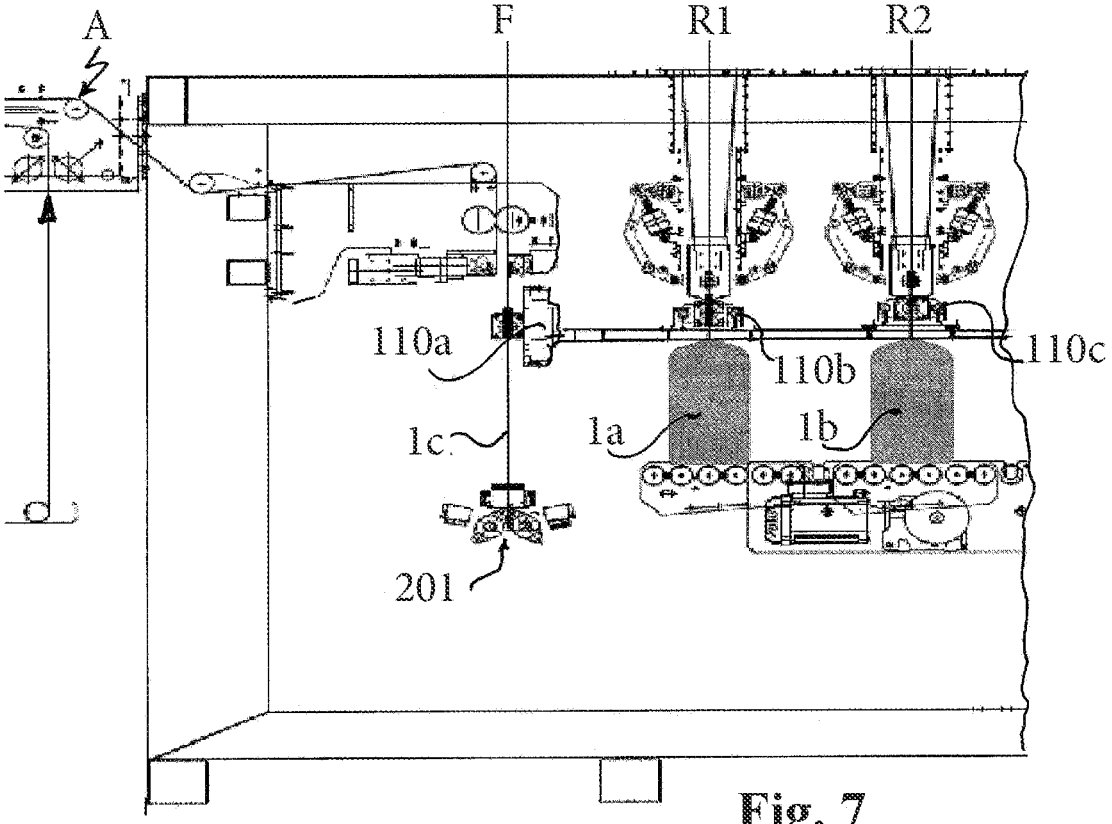
FIG. 7: is a view similar to that of FIG. 4 with a machine during filling of the first pair of bags and picking up of a third bag.
Figure 8:
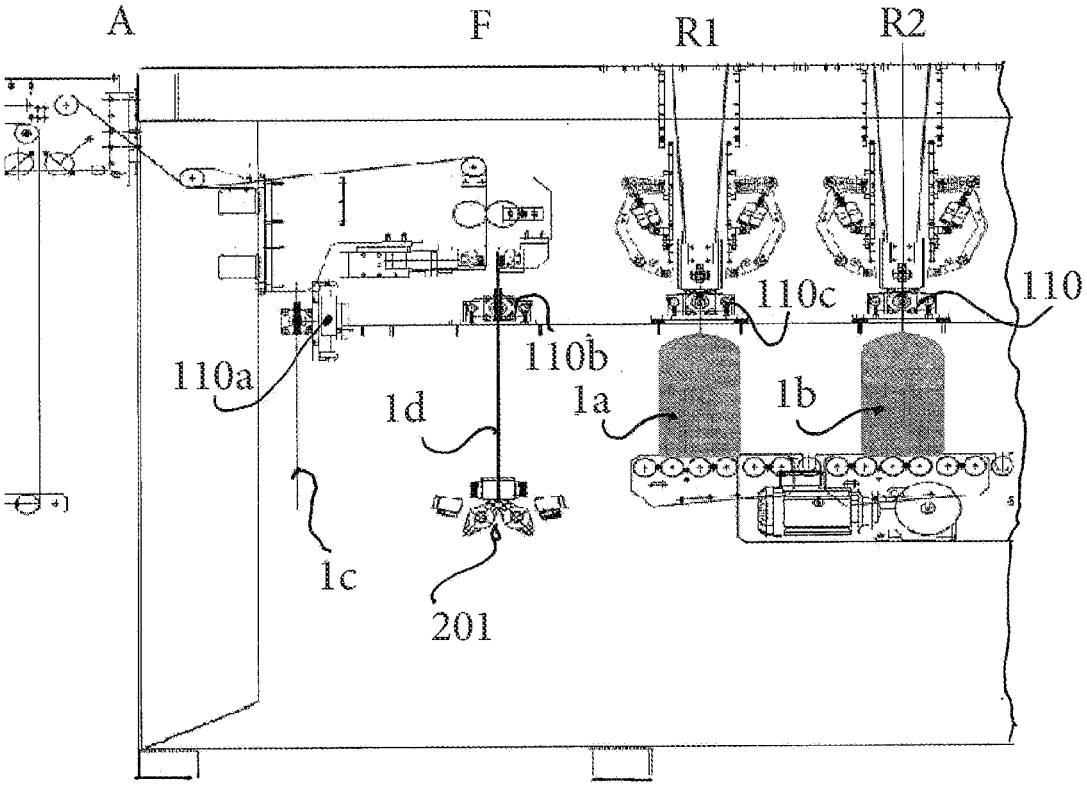
FIG. 8: is a view similar to that of FIG. 4 with a machine during filling of the first pair of bags and picking up of a fourth bag.
Figure 9:
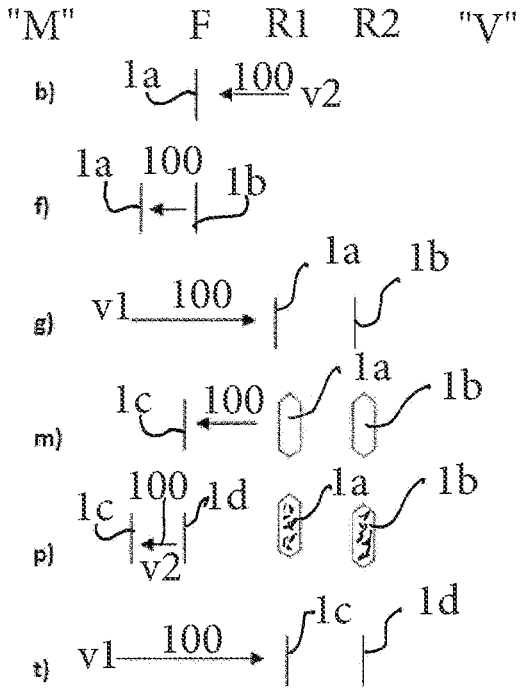
FIG. 9: is a simplified diagram illustrating operation of the machine according to FIG. 4.

As shown in FIG. 4, the following are assumed, solely for easier description and without a limiting meaning: a pair of reference axes, respectively, in a longitudinal direction, corresponding to the direction of movement of the bag inside the machine from an upstream inlet M to a downstream outlet V (with the longitudinal direction also defined is a first sense of movement V1 of means 100 for transporting the bags concordant with the advancing movement of the bags from upstream to downstream and a second sense of movement V2 thereof, from downstream to upstream, opposite to the advancing movement); and a transverse direction Y-Y perpendicular to the preceding direction and corresponding to the direction of orientation of the bag mouth (FIG. 9).

The machine according to the invention is therefore designed to fill bags with the mouth arranged perpendicularly relative to the direction of advancing movement thereof through the machine.

A first example of a machine according to the invention comprises essentially:

a station for feeding bags 1, designed to feed one bag 1 at a time, with the mouth arranged parallel to the transverse direction Y-Y, to a predefined sole pick-up position.

In the preferred example shown, a device A is provided for feeding a tubular material 101 unwound from a reel (not shown) and with a widthwise dimension and therefore an orientation of the bag mouth parallel to the transverse direction Y-Y and perpendicular to the longitudinal direction X-X of movement of the bags through the machine.

In this case the pick-up position coincides with a station F for forming bags 1 from the tubular material 101, with which means for sealing the bottom of the bag are associated, so as to form said bag 1 in said bag pick-up position. Preferably and in order to speed up the formation process, auxiliary means 201 may be provided for cooling said bottom seal, said means being associated with the forming station;

a first filling station R1 and a second filling station R2, each designed to fill with the material, from a metering apparatus (not shown), a respective bag, arranged in a respective first filling position R1 or second filling position R2 in the longitudinal direction X-X;

said feeding/forming stations F, first filling station R1 and second filling station R2 being arranged so that the pick-up position, the first filling position and the second filling position are arranged at a predefined equal distance from each other in the longitudinal direction X-X; below reference will be made to this distance also as a (uniform) step between the stations.

The machine also comprises:

-) means 100 for transporting the bags 1 from one station to the other in the longitudinal direction X-X, provided with devices for gripping the bags; the transport means consist, for example, of a generally polygonal and preferably quadrangular frame, which is displaceable in both the senses V1, V2 of the longitudinal direction X-X.

In detail, the means for gripping the bags 1 comprise: a plurality of pairs of means 110 for gripping bags being processed, the means of one pair being arranged opposite each other in the transverse direction Y-Y. Each pair of gripping means 110 is arranged along the carriage at a distance of one step from the preceding pair and from the next pair in the longitudinal direction X-X.

The number of said pairs of gripping means 110 is equal to at least twice the number of filling stations R1, R2.

The gripping means may be movable towards/away form each other in the transverse direction Y-Y in order to slacken/tension the mouth of the bag which is held, so as to allow opening/alignment thereof.

The first example of embodiment of the machine therefore envisages four pairs 110*a*, 110*b*, 110*c*, 110*d* of gripping means 110 associated with the movable frame 100.

The frame or carriage 100 is generally designed to move, performing single translation movements in the longitudinal direction, each with a displacement equal to one step V2 in the sense V2 opposite to the sense of advancing movement of the bags in the longitudinal direction X-X, and with a displacement equal to a number of steps equal to the number of filling stations R1, R2 present in the machine, in the sense V1 concordant with the advancing movement of the bags in the longitudinal direction X-X.

Each translation movement is understood as being a continuous translatory movement between the point of departure and the point of arrival.

In the example of the first embodiment shown, the carriage 100 performs a translation movement with a displacement equal to two steps at a time in the sense V1 concordant with the advancing movement of the bags in the longitudinal direction X-X.

According to preferred embodiments of the invention it is envisaged that:

in a first embodiment the filling stations comprise: grippers for gripping and retaining the bag during filling; valves which can be opened and closed for feeding/intercepting the product to be bagged supplied from an overlying storage hopper; stations of this type are known per se and are not described in detail. For this first embodiment, the carriage 100 may comprise grippers for gripping the bag 1 movable in both senses of the transverse direction Y-Y so as to cause opening of the bag mouth during transportation or underneath the associated filling station, and allow the entry of valves for guiding dropping of the product to be bagged; and closing of the mouth once filling has been performed, for example during transportation towards the machine outlet;

in a second embodiment of the machine, the filling stations comprise grippers for gripping and retaining the bag during filling, which are displaceable in both senses of the transverse direction Y-Y so as to cause opening of the bag mouth, allow entry of the valves of the filling device, and closing of the mouth, once filling has been performed, in each filling station; in this case, the carriage 100 may comprise grippers for gripping the bag to be filled which are fixed in the transverse direction Y-Y.

For both configurations sucker means may be provided, these being supplied under a vacuum and being movable in both senses of the longitudinal direction X-X so as to cause adhesion to the surfaces of the bag and facilitate opening of the bag mouth, the movement of the suckers being suitably synchronized with the approach movement of the bag gripping means arranged in the filling station and/or on the transport carriage 100.

Conveniently the machine may comprise devices 200 for supporting the bags which are being filled and/or are filled, said devices being designed to cooperate: initially with the grippers of the filling station and, thereafter, with the grippers of the carriage 100 during transportation of the bags which have in the meantime increased considerably in weight during filling.

The support device 200 may comprise a first section 210, situated underneath at least the filling stations R1 and R2, having an inclination variable from a lowered position, not interfering with the advancing movement of the bags which are still empty, into a position parallel to the longitudinal/transverse plane X-Y, and a second flat section 220 fixed and parallel to the same plane X-Y. Both sections comprise rotating rollers which are preferably motorized.

The support device 200 may furthermore be configured to support also the device 201 for cooling the seals on the bottom of the bag in the feeding/forming station.

Although only schematically indicated by 500, it is envisaged that the machine is associated with means for programming and controlling the various detection sensors and actuating elements which perform the automatic cycle of the machine.

Preferably, it is envisaged that each filling station R1, R2 comprises a respective deaeration device (conventional per se) which is installed on a respective bag mouth R1; R2 and which, once filling has been performed, enters into the bag in order to reduce the volume of the product before the bag mouth is closed.

Figure 10:
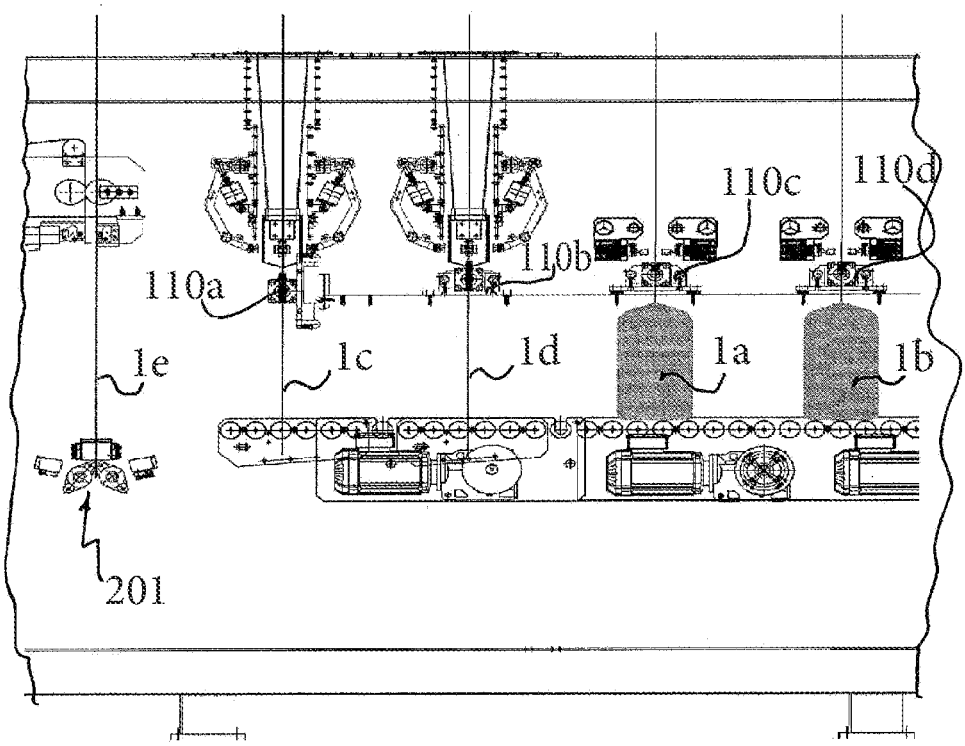
FIG. 10: is a side view of a second example of embodiment of a machine according to the present invention provided with stations for sealing the mouth of the bags (mouth sealing of first pair and transportation of a third and fourth bag for filling)

With the apparatus configurations described and illustrated above (FIGS. 4 and 10) for the first example of embodiment of the machine according to the invention, it is envisaged that the apparatus operates in accordance with the steps of the following method:

a) feeding a tubular material from the feeding unit A to the forming station F;

b) sealing of the bottom and cutting of a first bag 1*a* in the forming station F with forming of a first bag 1*a* arranged in the pick-up position;

c) translation of the transport means 100 with a displacement equal to one step in the longitudinal direction X-X and in the opposite sense V2 to the sense V1 of advancing movement of the bags from upstream M to downstream V, so as to bring the first gripping means 110*a* of the carriage 110*a* into the position for feeding the bag into the forming station F;

d) gripping of the first bag 1*c* by the first gripping means 110*a* in the pick-up position;

e) displacement of the carriage 100 by a further step in the longitudinal direction X-X and in the sense V2 opposite to the sense of advancing movement of the bags;

f) forming of a second bag 1*b* in the station F for forming and feeding the bag to the pick-up position; (it is understood that feeding of a bag to the pick-up position and translation of the transport carriage to said position may occur substantially simultaneously);

g) gripping of the second bag 1*b* formed by the second gripping means 110*b* in the pick-up position;

h) translation of the carriage 100 with displacement by a number of steps equal to the number of filling stations R1, R2 (in the example two steps), in the longitudinal direction X-X and in the sense V1 concordant with the sense of advancing movement of the bags from upstream M towards downstream V, so as to bring simultaneously the two bags, first bag 1*a* and second bag 1*b*, opposite the respective first filling station R1 and second filling station R2;

i) opening of the bag mouth during transportation from F to R1, R2 or preferably opposite the filling station;

j) gripping of the respective bag 1*a*, 1*b* by the grippers associated with the respective filling station R1, R2;

k) releasing of the bags by the gripping means 110 of the carriage 100;

l) formation of a further third bag 1*c* in the forming station F;

m) translation of the carriage 100 by one step in the sense V2 opposite to the advancing movement of the bags 1 so as to bring the first gripping means 110 into the pick-up position in the forming station F for picking up the third bag 1*c* formed and gripping of the third bag is by the first gripping means 110*a* in the pick-up station;

n) translation of the carriage 100 by one step in the sense V2 opposite to the advancing movement of the bags so as to bring the second gripping means 110*b* into the pick-up position in the forming station F;

o) formation of a fourth bag 1*d* in the forming station and positioning thereof in the pick-up position;

p) gripping of the fourth bag 1*d* by the gripping means 110*b* adjacent downstream to the gripping means which picked up the third bag 1*c;* q) simultaneous filling of the two bags 1*a*, 1*b* in the respective station R1, R2 with operation, if necessary, of the respective deaeration devices; preferably filling is performed at the same time as one or more of the steps for forming and gripping the third and fourth bags;

r) gripping of the two bags 1*a*, 1*b* of the first pair respectively by the third gripping means 110*c* and fourth gripping means 110*d* of the carriage 100 which have arrived underneath one of the filling stations R1, R2 during the previous step n) of translation of the transport carriage 100;

s) closing of the valves of the filling mouths and releasing of the first pair of bags 1*a*, 1*b* by the gripping means of the respective filling station R1, R2;

t) translation of the carriage 100 with displacement by two steps in the longitudinal direction X-X and in the sense V1 concordant with the advancing movement of the bags for simultaneous transportation of the first pair of bags 1*a*, 1*b* to the outlet and the second pair of bags 1*c*, 1*d* to a respective filling station R1, R2;

u) repetition of the cycle for the following bags to be formed, transported and filled.

Although not shown, for all the embodiments it is also envisaged that the bags, instead of being formed along the line, are prefabricated, for example picked up from a store associated with the filling machine and fed one after the other to the sole pick-up position for gripping by the gripping means 110 in a bag feeding station.

Figure 11:
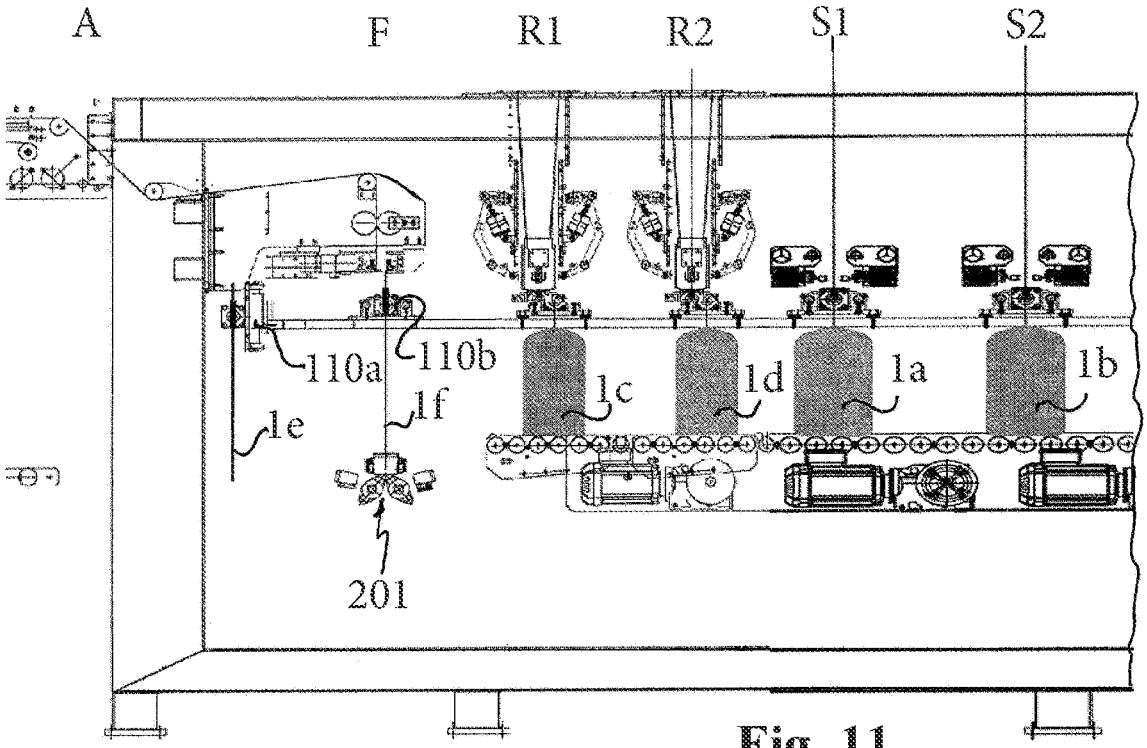
FIG. 11: is a view similar to that of FIG. 10 with a machine during sealing of the first pair of bags; filling of the second pair of bags; picking up of a third pair of bags.
Figure 12:
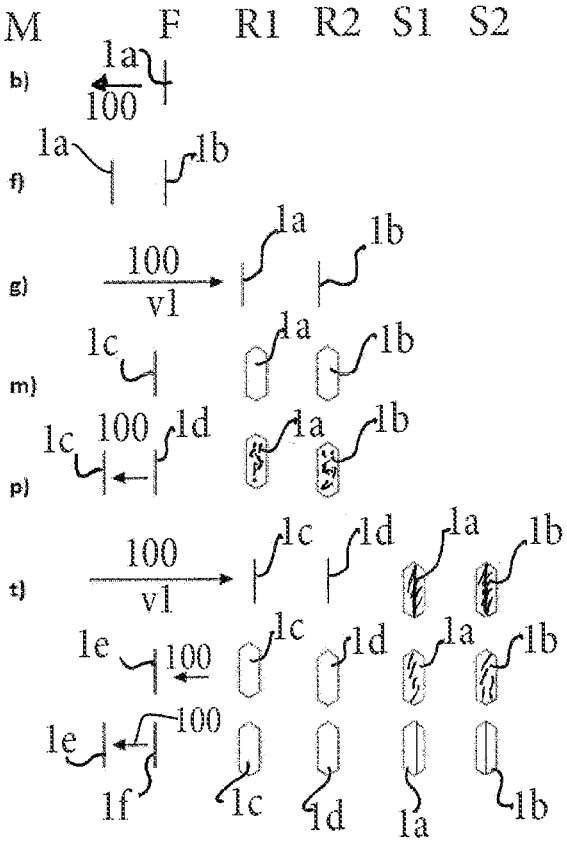
FIG. 12: is a simplified diagram illustrating operation of the machine according to FIG. 10.

As shown in FIGS. 11-12, a second embodiment of the machine according to the invention is envisaged where a first station S1 and a second station S2 for sealing the mouth of one of the pair of bags 1*a*, 1*b* filled and transported by the transport carriage 100 is inserted; the first station S1 is arranged at a distance of one step from the second filling station R2 and the second sealing station S2 is arranged at one step from the first sealing station S1 along the longitudinal direction X-X.

As shown in FIG. 12, the forming, transportation and filling steps a) to s) of the cycle are repeated unchanged, but, when filling of the bags 1*a*, 1*b* has been completed, the bags are removed by the pair of gripping means 110*a*, 110*d* of the carriage 100 arranged in the respective filling station and brought (step t) to one of the two stations S1, S2 for sealing the bag mouth by the translation movement of the carriage which brings the new bags 1*c*, 1*d* to the respective filling stations.

The bags with a sealed mouth may be then extracted by suitable means, for example by means of a suitable section of motorized rollers situated underneath the stations S1, S2.

Figure 13:
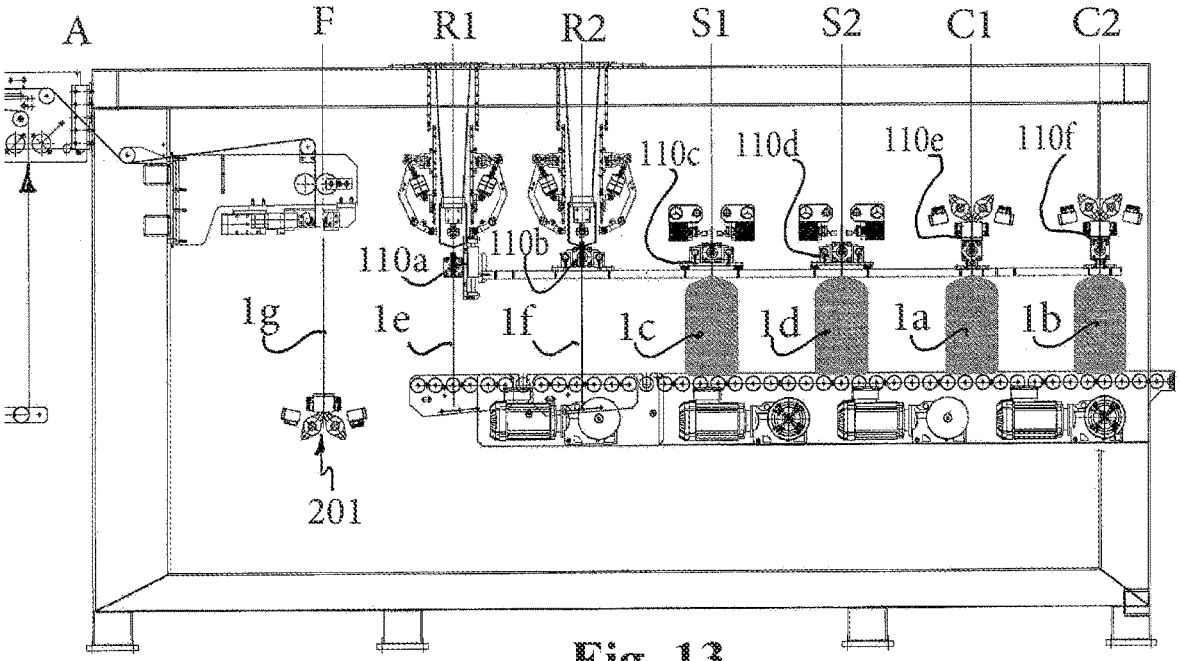
FIG. 13: is a side view of a third example of embodiment of a machine according to the present invention provided with stations for cooling the sealed mouth of the bags.
Figure 14:
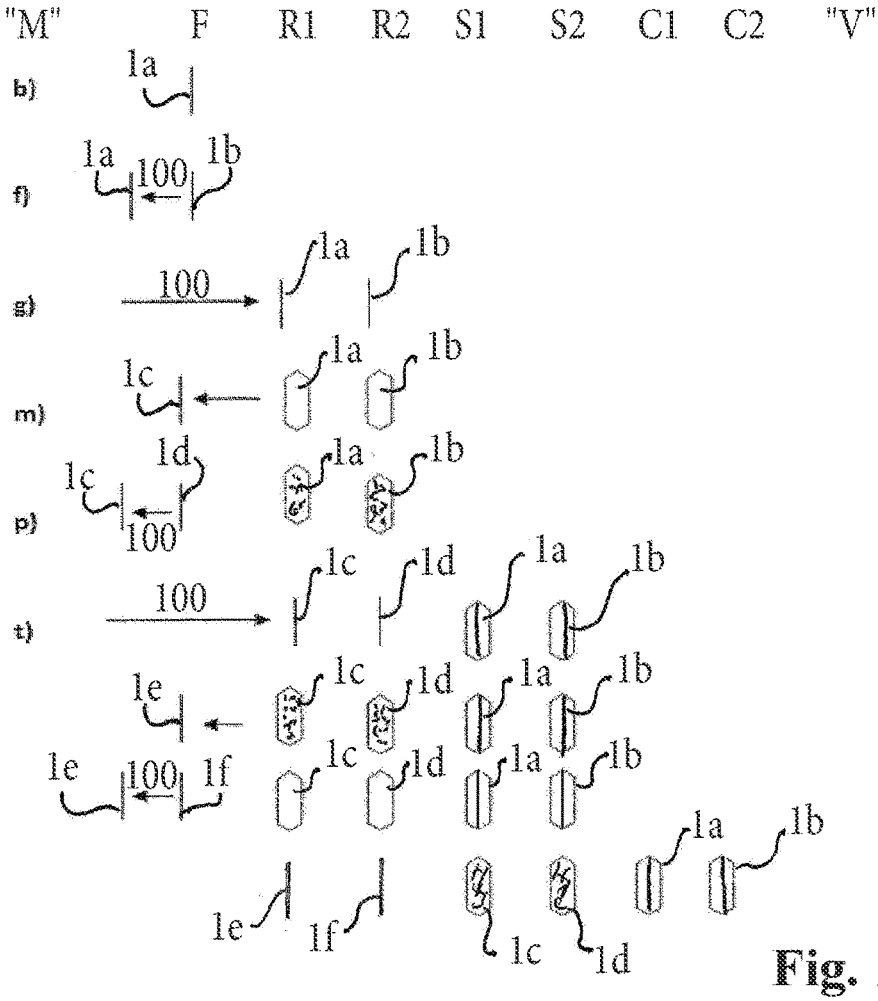
FIG. 14: is a simplified diagram illustrating operation of the machine according to FIG. 13.

FIGS. 13 and 14 show a further embodiment of the machine according to the invention in which a first station C1 and a second station C2 for cooling the sealed mouth of a closed and sealed bag are inserted. The first station C1 is arranged at a distance of one step from the second sealing station S2 and the second cooling station C2 is arranged at one step from the first station C1 along the longitudinal direction X-X.

The two cooling stations may be advantageously added in order to speed up cooling of the seal and reduce the waiting time of the two bags before they exit from the machine, said exit operation allowing the cycle to be continued with a further third pair of bags to be filled, resulting in an overall increase in productivity.

Figure 15:
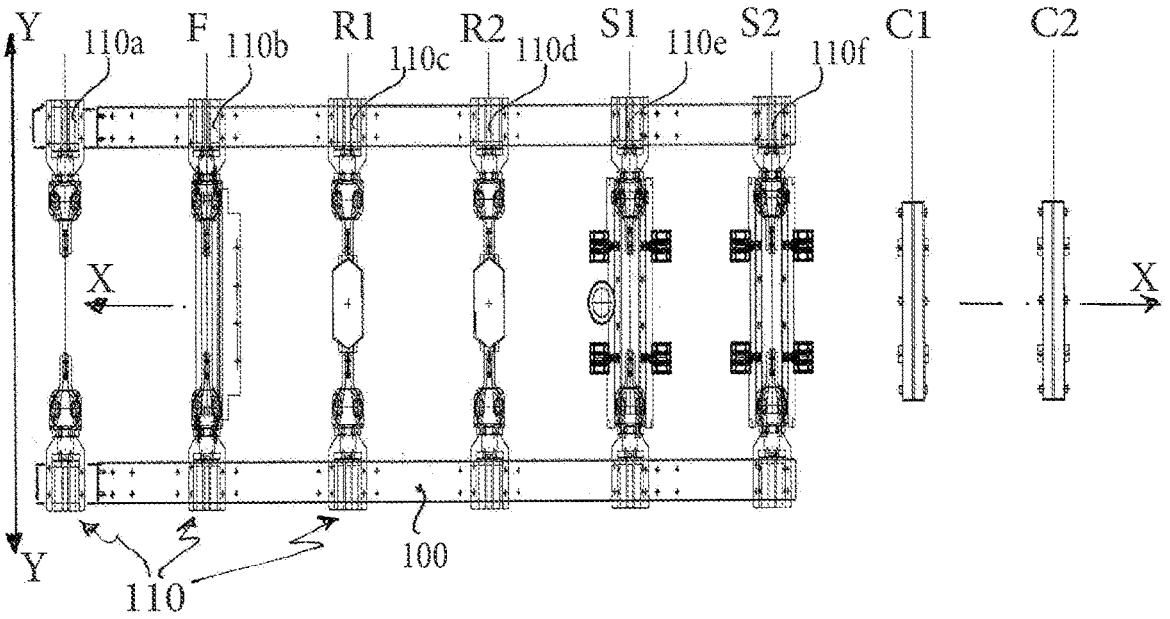
FIG. 15: is a plan view of the carriage for moving the bags.

Correspondingly and as shown in FIG. 15, the transport carriage 1100 comprises at least two further pairs 110*e*, 110*f* of gripping means arranged at a relative distance of one step downstream of the gripping means 110*c*, 110*d*.

As shown in FIGS. 13,14 the steps of the cycle are repeated unchanged as in the case of the machine with sealing stations S1, S2, but, when sealing of the bag mouths has been completed, the bags are removed by the further pairs of gripping means of the carriage 1100 and brought to a respective cooling station C1, C2.

In this way, the translation movement of the carriage 1100 corresponding to a number of steps equal to the number of filling steps, designed to transport the picked-up bags to the filling stations R1, R2 and the filled bags to the sealing stations S1, S2, causes the simultaneous transportation of the bags with a sealed mouth from the stations S1, S2 to the cooling stations C1, C2.

This variation of embodiment of the carriage 1100 can be used also with the embodiment of the machine with only sealing stations S1, S2, where the further pairs of gripping means 110*e*, 110*f* will be used to pick up the bags with a sealed mouth and transport them towards the machine outlet.

Figure 16:
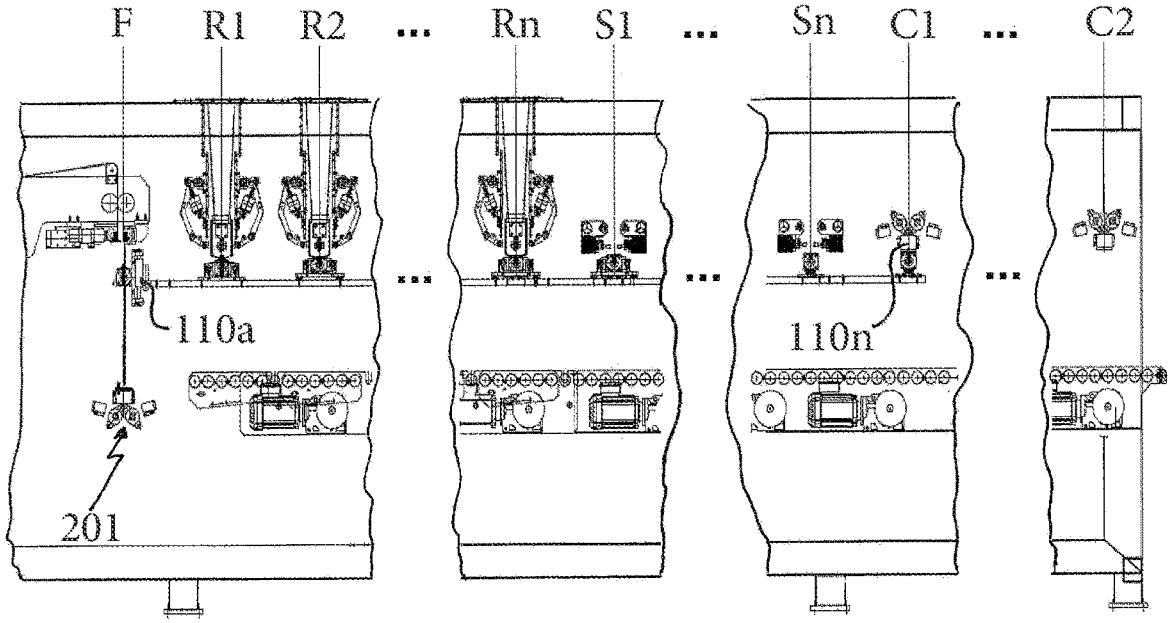
FIG. 16: is a side view of a general diagram of realization of a machine according to the present invention.

As shown in the example of FIG. 16, it is also envisaged that, in the case of an increased number n of filling stations R1, R2, . . . , Rn, for example three filling stations, there will be a corresponding increase in the length of both the frame and carriage which will carry a corresponding number of pairs of gripping means 110 equal at least to twice the number of filling stations, and in general equal to a multiple ≥2 of said number n of filling stations, depending on the presence of corresponding n sealing stations S1 . . . Sn and/or cooling stations C1, . . . , Cn. In particular, in a preferred configuration there is a number of pairs of gripping means equal to twice the number n of filling stations plus the number of cooling stations C1, . . . , Cn.

Similarly, the machine with n filling stations R1, R2, . . . , Rn may have a length suitable for allowing a displacement of the carriage in the sense V2 opposite to the direction of advancing movement of the bags by a total number of single steps upstream of the pick-up position corresponding to the number (n−1) of filling stations, less one, in order to allow the gripping of a corresponding number of formed bags 1*a*, 1*b*, . . . , 1*n*, before their transportation to the filling stations by means of a single translation movement in the same sense V1, with a displacement by a number of steps equal to the number n of filling stations Rn.

It is therefore clear how with the machine and the method according to the invention, which implement a continuous cycle within machines of the FFS type or the like, it is possible to achieve a substantial reduction in the downtime and a consequent increased hourly productivity compared to similar machines of the prior art, allowing for example the production for example of up to 1000 bags/h also in the case where the filling material is formed by powders which are difficult to process, in particular because it allows the filling of two or more bags in each machine cycle, reducing as far as possible the downtime due to the intermittent movement of transport means which displace the bags, and maintaining a compact size of the machine, in particular because of the single pick-up station and the fact that the direction of advancing movement is perpendicular to the bag mouth. Although described in connection with a number of embodiments and a number of preferred examples of implementation of the invention, it is understood that the scope of protection of the present patent is determined solely by the claims below.

The invention claimed is:

1. A machine for filling bags (1) with predefined quantities of loose products, the machine extending in a longitudinal direction (X-X) of an advancing movement of the bags (1) from an upstream inlet (M) to a downstream outlet (V), the machine comprising:

a station (A, F) for feeding the bags to a single pick-up position, each bag of said bags having a mouth extending in a transverse direction (Y-Y) perpendicular to the longitudinal direction (X-X) of advancing movement;

a plurality of filling stations (R1, R2, Rn) for filling the bags, including at least a first filling station (R1) and a second filling station (R2), arranged in succession along the longitudinal direction (X-X) of the advancing movement of the bags (1) downstream of the single pick-up position, each filling station of the plurality of filling stations (R1, R2, Rn) being associated with a respective gripping means for gripping a respective bag of said bags, said single pick-up position and each said filling station of the plurality of filling stations arranged at a predefined and identical relative distance from one another, said relative distance corresponding to a step in the longitudinal direction (X-X);

transport means (100, 1100) for transporting the bags in the longitudinal direction, wherein the bags are transportable by the transport means in a forward sense of movement (V1) in the longitudinal direction (X-X), concordant with the advancing movement of the bags from the upstream inlet to the downstream outlet, and in a rearward sense of movement (V2) in the longitudinal direction (X-X), opposite to the forward sense (V1) of movement, wherein the transport means are provided with a plurality of pairs of transport gripping means (110) for gripping the bags, the plurality of pairs of transport gripping means including a number of pairs of transport gripping means equal to at least twice a number of filling stations of the plurality of filling stations, each pair of transport gripping means of the plurality of pairs of transport gripping means being arranged at said relative distance of said one step in the longitudinal direction (X-X) from an adjacent pair of transport gripping means, and each transport gripping means of each said pair of transport gripping means arranged oppositely in the transverse direction (Y-Y) to a corresponding transport gripping means of said pair of transport gripping means;

the machine configured so that said transport means (100, 110) perform single translation movements, each single translation movement of said single translation movements with a displacement equal to one said step in the longitudinal direction (X-X) in the rearward sense (V2) of movement in the longitudinal direction (X-X) and with a displacement equal to a number of steps in the longitudinal direction (X-X) equal to the number of filling stations (R1, R2, Rn) in the forward sense (V1) of movement in the longitudinal direction (X-X).

2. The machine according to claim 1, wherein the transport means (100; 1100) are operated so as to perform a number of single translation movements in the rearward sense (V2) of movement in the longitudinal direction equal to the number of filling stations of the plurality of filling stations (R1, R2, Rn) before performing said single translation movement in the forward sense (V1) of movement concordant with the advancing movement of the bags in the longitudinal direction (X-X).

3. The machine according to claim 1, wherein the number of filling stations is equal to two.

4. The machine according to claim 1, wherein the machine is a forming and filling machine, in which the bags fed one at a time to the single pick-up position are formed along a line from a tubular material (101).

5. The machine according to claim 1, further comprising a number of sealing stations (S1, S2, Sn) for sealing the mouth of said bags, the number of sealing stations equal to the number of filling stations of the plurality of filling stations (R1, R2, Rn), said sealing stations arranged in succession in the longitudinal direction (X-X) at said relative distance of said step in the longitudinal direction (X-X) from each adjacent sealing station and from a last filling station of said plurality of filling stations in the longitudinal direction (X-X), wherein each sealing station of said number of sealing stations is configured to seal the mouth of a respective bag.

6. The machine according to claim 5, further comprising a number of cooling stations (C1, C2, Cn) for cooling the mouth of said bags after the mouth is sealed, the number of cooling stations equal to the number of filling stations of the plurality of filling stations (R1, R2, Rn), said cooling stations arranged in succession at said relative distance of said step in the longitudinal direction (X-X) from each adjacent cooling station and from a last sealing station of said sealing stations, wherein each cooling station of said number of cooling stations is configured to cool the mouth of a respective one of said bags.

7. The machine according to claim 1, wherein the number of pairs of transport gripping means is a multiple ≥2 of the number of filling stations of the plurality of filling stations.

8. The machine of claim 7, wherein the number of pairs of transport gripping means is equal to twice the number of filling stations of the plurality of filling stations, plus a number of cooling stations.

9. The machine according to claim 1, wherein the transport means further comprises a polygonal, frame or carriage (100) which carries the plurality of pairs of transport gripping means (110) and is movable translatably in both senses (V1, V2) of the longitudinal direction X-X.

10. The machine of claim 9, wherein the polygonal frame or carriage is quadrangular.

11. A method of filling bags (1) with quantities of loose products using a machine, the machine comprising:

a station (A, F) for feeding the bags to a single pick-up position, each bag of the bags having a mouth extending in a transverse direction (Y-Y) perpendicular to a longitudinal direction (X-X) of advancing movement of the bags from an upstream inlet to a downstream outlet;

a plurality of filling stations (R1, R2, Rn) for filling the bags, including at least a first filling station (R1) and a second filling station (R2), arranged in succession along the longitudinal direction (X-X) of the advancing movement of the bags (1) downstream of the single pick-up position, each filling station of the plurality of filling stations (R1, R2, Rn) being associated with a respective gripping means for gripping a respective bag of said bags to be filled, the single pick-up position and each said filling station of the plurality of filling stations arranged at a predefined and identical relative distance from one another, said relative distance corresponding to a step in the longitudinal direction (X-X);

transport means (100, 1100) for transporting the bags in the longitudinal direction (X-X), wherein the bags are transportable by the transport means in a forward sense of movement (V1) in the longitudinal direction (X-X) concordant with the advancing movement of the bags from the upstream inlet to the downstream outlet and in a rearward sense of movement (V2) in the longitudinal direction (X-X), opposite to the forward sense (V1) of movement, wherein the transport means are provided with a plurality of pairs of transport gripping means (110) for gripping the bags, the plurality of pairs of transport gripping means including a number of pairs of transport gripping means equal to at least twice a number of filling stations of the plurality of filling stations, each pair of transport gripping means of the plurality of pairs of transport gripping means being arranged at said relative distance of one said step in the longitudinal direction (X-X) from an adjacent pair of transport gripping means, and each transport gripping means of each said pairs of transport gripping means arranged oppositely in the transverse direction (Y-Y) to a corresponding transport gripping means of said pair of transport gripping means;

wherein the transport means (100, 110) is configured to perform single translation movements, each single translation movement of said single translation movements with a displacement equal to one said step in the rearward sense (V2) of movement in the longitudinal direction (X-X) and with a displacement equal to a number of steps in the longitudinal direction (X-X) equal to the number of filling stations of the plurality of filling stations (R1, R2, Rn) in the forward sense (V1) of movement in the longitudinal direction (X-X); and the method comprising:

a) feeding a first bag (1) of said bags to the single pick-up position (F);

b) translating the transport means (100; 1100) one said step in the rearward sense (V2) of movement in the longitudinal direction (X X), so as to bring a first pair of transport gripping means (110*a*) of the plurality of pairs of transport gripping means into the single pick-up position;

c) gripping the first bag (1*a*) with the first pair of transport gripping means (110*a*) in the single pick-up position, thereby obtaining a first picked-up bag;

d) translating the transport means (100; 1100) one said step in the rearward sense (V2)) of movement in the longitudinal direction (X-X);

e) feeding a second bag (1*b*) of said bags to the single pick-up position (F);

f) gripping the second bag (1*b*) in the single pick-up position with a second pair of transport gripping means (110*b*) of the plurality of pairs of transport gripping means which are adjacent to, and downstream in the longitudinal direction (X-X) of, the first pair of gripping means, thereby obtaining a second picked-up bag;

g) translating the transport means (100; 1100) in the forward sense (V1) of movement in the longitudinal direction (X-X) the number of steps in the longitudinal direction equal to the number of filling stations of the plurality of filling stations, so as to bring each said picked-up bag gripped by a respective pair of transport gripping means, including the first bag and the second bag, into a respective filling station (R1, R2, Rn) of the plurality of filling stations with a single translation movement;

h) gripping said each picked-up bag gripped by the respective pair of transport gripping means, including the first bag and the second bag, with the respective gripping means associated with the respective filling station (R1, R2, Rn) and releasing said each picked-up bag gripped by the respective pair of transport gripping means, including the first bag and the second bag, from the respective pair of transport gripping means;

i) simultaneously filling each bag gripped by the respective gripping means associated with the respective filling station, including the first bag and the second bag, in the respective filling station (R1, R2, Rn), thereby obtaining a plurality of filled bags; and j) conveying each filled bag of the plurality of filled bags towards the downstream outlet.

12. The method according to claim 11, further comprising:

repeating, before the step g), steps $d_i$) to $f_i$) a number of times equal to the number of filling stations (R1, R2, Rn) minus two, the steps $d_i$) to $f_i$) including:

$d_i$) translating the transport means (100; 1100) one said step in the rearward sense (V2) of movement in the longitudinal direction (X-X) so as to bring a next pair of transport gripping means to the single pick-up position;

$e_i$) feeding a further bag to the single pick-up position (F); and $f_i$) gripping the further bag with said next pair of transport gripping means, thereby obtaining a further picked-up bag.

13. The method according to claim 12, further comprising opening the mouth of said each bag gripped by the respective gripping means associated with the respective filling station before the step of filling the bags (1), the opening of the mouth performed by the respective pair of transport gripping means (110) or by the respective gripping means associated with the respective filling station.

14. The method of claim 13, wherein a sucker means associated with each said filling station of the plurality of filling stations, acting parallel to the longitudinal direction (X-X), performs the opening of the mouth of each said bag of the bags.

15. The method according to claim 12, further comprising:

after step h):

a1) feeding another bag (1*c*) to the single pick-up position (F);

b1) translating the transport means (100; 1100) one said step in the rearward sense (V2) of movement in the longitudinal direction (X-X), so as to bring the first pair of transport gripping means (110*a*) into the single pick-up position;

c1) gripping said another bag (1*c*) by the first pair of transport gripping means (110*a*) in the single pick-up position, thereby obtaining another picked-up bag;

d1) translating the transport means (100; 1100) one said step in the rearward sense (V2) of movement in the longitudinal direction (X-X);

e1) feeding a next bag (1*d*) to the single pick-up position (F);

f1) gripping the next bag (1*d*) with the second pair of transport gripping means (110*b*) which are adjacent to, and downstream in the longitudinal direction (X-X) of, the first pair of gripping means (110*a*) which picked up said another bag (1*c*) in the single pick-up position, thereby obtaining a next picked-up bag;

f2) repeating the following steps $d_i$) to $f_i$) a number of times equal to the number of filling stations (R1, R2, Rn) minus two to obtain a corresponding number of further picked-up bags:

$d_i$) translating the transport means (100; 1100) one said step in the rearward sense (V2) of movement in the longitudinal direction (X-X) so as to bring a next pair of transport gripping means to the single pick-up position;

$e_i$) feeding a further bag to the single pick-up position (F);

$f_i$) gripping the further bag with said next pair of transport gripping means, thereby obtaining a further picked-up bag; and after step i):

f3) gripping each filled bag arranged in the respective filling station (R1, R2, Rn) by a respective pair of transport gripping means (110) and releasing said each filled bag from the respective gripping means associated with the respective filling station (R1, R2, Rn);

g1) translating the transport means (100; 1100) in the forward sense (V1) of movement in the longitudinal direction (X-X) the number of steps equal to the number of filling stations of the plurality of filling stations, so as to bring said another picked up bag, said next picked-up bag and each of said number of further picked-up bags into a respective filling station (R1, R2, Rn) of said plurality of filling stations and convey away each of said filled bags towards the downstream outlet with a single translation movement;

h1) gripping each newly presented picked-up bag by the respective gripping means associated with the respective filling station (R1, R2, Rn) and releasing the respective pairs of transport gripping means from said newly presented picked-up bags;

ii) simultaneously filling said each newly presented picked-up bag in the respective filling station (R1, R2, Rn).

16. The method according to claim 11, further comprising:

after step h):

a1) feeding another bag (1*c*) to the single pick-up position (F);

b1) translating the transport means (100; 1100) one said step in the rearward sense (V2) of movement in the longitudinal direction (X-X), so as to bring the first pair of transport gripping means (110*a*) into the single pick-up position;

c1) gripping said another bag (1*c*) by the first pair of transport gripping means (110*a*) in the single pick-up position;

d1) translating the transport means (100; 1100) one said step in the rearward sense (V2) of movement in the longitudinal direction (X X);

e1) feeding a next bag (1*d*) to the single pick-up position (F);

f1) gripping the next bag (1*d*) with the second pair of transport gripping means (110*b*) which are adjacent to, and downstream in the longitudinal direction (X-X) of, the first pair of gripping means (110*a*) which picked up said another bag (1*c*) in the single pick-up position; and after step i):

f2) gripping each filled bag, including the first bag and the second bag (1*a*, 1*b*), arranged in the respective filling station (R1, R2, Rn), by a respective pair of transport gripping means (110) and releasing said each filled bag, including the first bag and the second bag (1*a*, 1*b*), from the respective gripping means associated with the respective filling station (R1, R2, Rn);

g1) translating the transport means (100; 1100) in the forward sense (V1) of movement in the longitudinal direction (X-X) the number of steps equal to the number of filling stations of the plurality of filling stations, so as to bring said another bag and said next bag (1*c*, 1*d*) into the respective filling station (R1, R2, Rn) and convey away said each filled bag, including the first bag and the second bag, towards the downstream outlet with a single translation movement;

h1) gripping each newly filled bag, including said another bag and said next bag (1*c*, 1*d*), by the respective gripping means associated with the respective filling station (R1, R2, Rn) and releasing of the bags by the first pair of transport gripping means from said another bag and the second pair of transport gripping means from said next bag;

ii) simultaneously filling said another bag and said next bag (1*c*, 1*d*) in the respective filling station (R1, R2, Rn).

17. The method according to claim 11, wherein, after simultaneously filling each bag gripped by the respective gripping means associated with the respective filling station, including the first bag and the second bag, in the respective filling station, each filled bag, including the first bag and the second bag, is gripped by a respective pair of transport gripping means (110), and the transport means advance in the forward sense of movement in the longitudinal direction (X-X) by the number of steps equal to the number of filling stations (R1, R2, Rn) so as to bring said each filled bag into a respective sealing station of a plurality of sealing stations (S1, S2, Sn) for sealing the mouth of said each filled bag, each sealing station of the plurality of sealing stations arranged in succession at the relative distance of one said step in the longitudinal direction from each adjacent sealing station of the plurality of sealing stations, and one sealing station of the plurality of sealing stations arranged at the relative distance of one said step from a last filling station of the plurality of filling stations in the longitudinal direction (X-X), the plurality of sealing stations including a number of sealing stations equal to the number of filling stations present in the plurality of filling stations.

18. The method according to claim 17, wherein, following the sealing of said each filled bag in the respective sealing station (S1, S2, Sn), each sealed bag, including the first bag and the second bag, is gripped by a respective one of said pain of transport gripping means (110) and the transport means (100; 1100) advance in the forward sense of movement in the longitudinal direction (X-X) by the number of steps equal to the number of filling stations (R1, R2, Rn), so as to bring said each sealed bag, including the first bag and the second bag, opposite a respective cooling station of a plurality of cooling stations (C1, C2, Cn) for cooling the sealed mouth of said each sealed bag, each cooling station of the plurality of cooling stations arranged in succession at one said step from each adjacent cooling station of the plurality of cooling stations, and one cooling station of the plurality of cooling stations arranged at the relative distance of one said step from a last sealing station of the plurality of sealing stations, the plurality of cooling stations including a number of cooling stations equal to the number of filling stations (R1, R2, Rn) present in the plurality of filling stations.

* * * * *